US012269656B2

(12) United States Patent
Holley, Jr.

(10) Patent No.: US 12,269,656 B2
(45) Date of Patent: Apr. 8, 2025

(54) CARTON FOR ARTICLES

(71) Applicant: Graphic Packaging International, LLC, Atlanta, GA (US)

(72) Inventor: John Murdick Holley, Jr., Lawrenceville, GA (US)

(73) Assignee: Graphic Packaging International, LLC, Atlanta, GA (US)

( * ) Notice: Subject to any disclaimer, the term of this patent is extended or adjusted under 35 U.S.C. 154(b) by 64 days.

(21) Appl. No.: 18/140,038

(22) Filed: Apr. 27, 2023

(65) Prior Publication Data

US 2024/0076095 A1 Mar. 7, 2024

Related U.S. Application Data

(60) Provisional application No. 63/335,903, filed on Apr. 28, 2022.

(51) Int. Cl.
*B65D 5/50* (2006.01)
*B65D 5/20* (2006.01)

(52) U.S. Cl.
CPC ..... *B65D 5/5021* (2013.01); *B65D 5/2033* (2013.01); *B65D 5/2076* (2013.01)

(58) Field of Classification Search
CPC ..... B65D 5/20; B65D 5/2033; B65D 5/2076; B65D 5/4608; B65D 5/50; B65D 5/5021; B65D 71/36
USPC ..... 206/427, 433
See application file for complete search history.

(56) References Cited

U.S. PATENT DOCUMENTS

| | | | |
|---|---|---|---|
| 2,331,137 | A | 10/1943 | Rous |
| 2,877,894 | A | 3/1959 | Forrer |
| 3,152,688 | A | 10/1964 | Mahon |
| 3,167,214 | A | 1/1965 | Mahon |
| 3,176,902 | A | 4/1965 | Champlin |
| 3,206,097 | A | 9/1965 | Holmes |
| 3,252,649 | A | 5/1966 | Graser et al. |
| 3,255,919 | A | 6/1966 | Koolnis |

(Continued)

FOREIGN PATENT DOCUMENTS

| | | |
|---|---|---|
| EP | 0 024 782 A1 | 3/1981 |
| EP | 332 153 B1 | 9/1991 |

(Continued)

OTHER PUBLICATIONS

International Search Report and Written Opinion for PCT/US2023/020108 dated Aug. 11, 2023.

*Primary Examiner* — Bryon P Gehman
(74) *Attorney, Agent, or Firm* — Womble Bond Dickinson (US) LLP

(57) ABSTRACT

A carton for containing plurality of articles. The carton can comprise a plurality of panels that extends at least partially around an interior of the carton. The plurality of panels can comprise a side panel. A plurality of end flaps can be respectively foldably connected to respective panels of the plurality of panels. The plurality of end flaps can at least partially form a closed end of the carton, and the plurality of end flaps can comprise a side end flap. A bevel panel can extend along a corner of the carton so that the side end flap is at least partially connected to the side panel by the bevel panel. The bevel panel can comprise features that are shaped and located at the corner according to geometric aspects of one or more articles of the plurality of articles.

33 Claims, 4 Drawing Sheets

(56) References Cited

U.S. PATENT DOCUMENTS 3,337,043 A 8/1967 Parker
3,355,012 A 11/1967 Weiss
3,367,557 A 2/1968 Farquhar
3,386,570 A 6/1968 Lock
3,432,029 A 3/1969 Brown
3,669,342 A 6/1972 Funkhouser
3,670,950 A 6/1972 Rossi
3,679,121 A 7/1972 Morgese
3,687,282 A 8/1972 Owen
3,715,029 A 2/1973 Wood
3,747,801 A 7/1973 Graser
3,767,042 A 10/1973 Ganz
3,797,729 A 3/1974 Holmes
3,923,235 A 12/1975 Roccaforte
3,942,631 A 3/1976 Sutherland et al.
3,963,121 A 6/1976 Kipp
3,977,518 A 8/1976 Arneson
4,034,852 A 7/1977 Forrer
4,093,068 A 6/1978 Smrt
4,095,693 A 6/1978 Killy
4,095,735 A 6/1978 Stone
4,101,069 A 7/1978 Wood
4,131,230 A 12/1978 Koehlinger et al.
4,146,168 A 3/1979 Hartline
4,186,867 A 2/1980 Wood
4,202,446 A 5/1980 Sutherland
4,256,226 A 3/1981 Stone
4,295,562 A 10/1981 Wood
4,324,328 A 4/1982 Champlin
4,328,891 A 5/1982 Elward
4,330,079 A 5/1982 Wood
4,398,631 A 8/1983 Graser
4,421,232 A 12/1983 Konaka
4,424,901 A 1/1984 Lanier
4,437,606 A 3/1984 Graser
4,438,843 A 3/1984 Graser
4,463,852 A 8/1984 Stone
4,465,180 A 8/1984 Klygis
4,470,503 A 9/1984 Stone
4,498,581 A 2/1985 Dutcher
4,498,618 A 2/1985 Sutherland
4,505,696 A 3/1985 Wright et al.
4,533,047 A 8/1985 Calvert
4,545,485 A 10/1985 Oliff
4,574,997 A 3/1986 Ikeda
4,600,140 A 7/1986 Milliens
4,708,284 A 11/1987 Sutherland et al.
4,883,168 A 11/1989 Dreyfus
4,890,737 A 1/1990 Kadleck et al.
4,890,738 A 1/1990 Carer
4,919,266 A 4/1990 McIntosh, Jr. et al.
4,925,019 A 5/1990 Ganz et al.
5,002,186 A 3/1991 Cooper
5,002,225 A 3/1991 Bienaime
D316,672 S 5/1991 Wood
5,020,668 A 6/1991 Schuster
5,022,525 A 6/1991 Schuster
5,031,770 A 7/1991 Chaussadas
5,044,503 A 9/1991 Wein
5,080,280 A 1/1992 Kraus
5,094,347 A 3/1992 Schuster
5,107,986 A 4/1992 Cooper
5,131,588 A 7/1992 Oliff
5,145,067 A 9/1992 Carver
5,158,177 A 10/1992 Negelen et al.
5,167,325 A 12/1992 Sykora
5,246,112 A 9/1993 Stout et al.
5,297,673 A 3/1994 Sutherland
5,310,050 A 5/1994 Sutherland
5,311,984 A 5/1994 Harris
5,328,080 A 7/1994 Holley, Jr.
5,360,113 A 11/1994 Harris
5,385,234 A 1/1995 Stout et al.
5,390,784 A 2/1995 Sutherland
5,390,848 A 2/1995 Gungner et al.
5,437,363 A 8/1995 Gungner
5,439,112 A 8/1995 De Guglielmo et al.
5,443,203 A 8/1995 Sutherland
5,472,090 A 12/1995 Sutherland
5,476,217 A 12/1995 Moncrief et al.
5,484,059 A 1/1996 Sutherland
5,549,197 A 8/1996 Sutherland
5,579,904 A 12/1996 Holley, Jr.
5,582,289 A 12/1996 Wright
5,595,291 A 1/1997 Negelen
5,595,292 A 1/1997 Bates
5,595,299 A 1/1997 LeBras
5,605,228 A 2/1997 Baxter
5,620,094 A 4/1997 Naumann
5,653,340 A 8/1997 Daniel
5,671,845 A 9/1997 Harris
5,699,957 A 12/1997 Blin et al.
5,765,685 A 6/1998 Roosa
5,775,572 A 7/1998 Oliff
5,941,389 A 8/1999 Gomes
5,947,367 A 9/1999 Miller et al.
5,975,286 A 11/1999 Oliff
5,975,287 A 11/1999 Negelen
5,979,645 A 11/1999 Holley, Jr.
5,984,086 A 11/1999 Fousghee et al.
6,149,002 A 11/2000 Tiramani et al.
6,155,412 A 12/2000 LeBras et al.
6,170,741 B1 1/2001 Skolik et al.
6,189,687 B1 2/2001 Bakx
6,213,297 B1 4/2001 Gale
6,241,083 B1 6/2001 Harrelson
6,247,585 B1 6/2001 Holley, Jr.
6,273,330 B1 8/2001 Oliff et al.
6,295,789 B1 10/2001 Muller
6,315,111 B1 11/2001 Sutherland
6,315,123 B1 11/2001 Ikeda
6,536,656 B2 3/2003 Auclair et al.
6,615,984 B2 9/2003 Saulas et al.
6,669,083 B2 12/2003 Bates
6,695,137 B2 2/2004 Jones et al.
6,877,600 B2 4/2005 Sutherland
6,896,130 B2 5/2005 Theelen
6,948,293 B1 9/2005 Eckermann et al.
6,983,874 B2 1/2006 Bakx
6,997,372 B2 2/2006 Gasparowicz
7,028,839 B2 4/2006 Belloli et al.
7,048,113 B2 5/2006 Gomes
7,063,208 B2 6/2006 Lebras
7,070,045 B2 7/2006 Theelen
7,134,547 B2 11/2006 Auclair
7,175,020 B2 2/2007 Sutherland et al.
7,234,591 B2 6/2007 LeBras et al.
7,374,038 B2 5/2008 Smalley
7,427,010 B2 9/2008 Sutherland
7,467,729 B2 12/2008 Lown et al.
7,699,215 B2 4/2010 Spivey, Sr.
7,703,666 B2 4/2010 Hand et al.
7,780,067 B2 8/2010 Holley, Jr.
7,870,994 B2 1/2011 Spivey, Sr. et al.
7,913,844 B2 3/2011 Spivey, Sr.
7,966,789 B2 6/2011 Graham et al.
8,061,587 B2 11/2011 Blin
8,070,052 B2 12/2011 Spivey, Sr.
8,376,214 B2 2/2013 Spivey et al.
9,022,217 B2 5/2015 Holley, Jr.
9,205,939 B2 * 12/2015 Disrud ..... B65B 61/207
9,284,084 B2 * 3/2016 Schmal ..... B65D 71/16
9,481,501 B2 * 11/2016 Schmal ..... B65D 5/5007
9,499,319 B2 * 11/2016 Schmal ..... B65D 5/5007
9,573,744 B2 * 2/2017 Schmal ..... B65D 5/5007
10,399,719 B2 * 9/2019 Disrud ..... B65D 71/18
10,940,974 B2 * 3/2021 Walling ..... B65D 71/36
11,912,484 B2 * 2/2024 Gonzalez Manzano ..... B65B 11/004
2001/0017315 A1 8/2001 Baroudi
2004/0000494 A1 1/2004 Sutherland
2004/0164135 A1 8/2004 Gong et al.
2007/0056869 A1 3/2007 Tokarski
2007/0181658 A1 8/2007 Sutherland

(56) References Cited

U.S. PATENT DOCUMENTS

| | | | |
|---|---|---|---|
| 2007/0215682 | A1 | 9/2007 | Bates et al. |
| 2007/0277481 | A1 | 12/2007 | LeBras |
| 2009/0032425 | A1 | 2/2009 | Perkinson |
| 2009/0065559 | A1 | 3/2009 | Parkes |
| 2009/0236408 | A1 | 9/2009 | Spivey, Sr. et al. |
| 2010/0140336 | A1 | 6/2010 | Ho Fung |
| 2010/0237138 | A1 | 9/2010 | Bradford |
| 2011/0011924 | A1 | 1/2011 | Spivey, Sr. et al. |
| 2011/0065558 | A1 | 3/2011 | Smalley |
| 2011/0233091 | A1 | 9/2011 | Block et al. |
| 2011/0284622 | A1 | 11/2011 | Boukredine |
| 2011/0290867 | A1 | 12/2011 | Schemmel et al. |
| 2012/0279897 | A1 | 11/2012 | Schmal et al. |
| 2013/0015090 | A1 | 1/2013 | Bates et al. |
| 2013/0220873 | A1 | 8/2013 | Holley, Jr. |
| 2017/0101240 | A1 | 4/2017 | Boersma et al. |

FOREIGN PATENT DOCUMENTS

| | | | |
|---|---|---|---|
| EP | 630 825 | A2 | 12/1994 |
| EP | 0 901 969 | B1 | 4/2000 |
| EP | 1 065 151 | A1 | 1/2001 |
| EP | 1 103 481 | B1 | 8/2004 |
| EP | 1 010 637 | B1 | 9/2004 |
| EP | 1 125 858 | B1 | 9/2004 |
| EP | 1 381 545 | B1 | 10/2005 |
| EP | 1 334 043 | B1 | 12/2005 |
| EP | 1 151 935 | B1 | 8/2006 |
| EP | 1 513 737 | B1 | 11/2006 |
| EP | 2 055 648 | A1 | 5/2009 |
| EP | 1 749 755 | B1 | 12/2011 |
| FR | 2619363 | A1 | 2/1989 |
| FR | 2684078 | A3 | 5/1993 |
| JP | 11-124129 | A | 5/1999 |
| JP | 3039805 | | 3/2000 |
| JP | 2008 213894 | A | 9/2008 |
| WO | WO 92/09498 | | 6/1992 |
| WO | WO 93/14991 | A1 | 8/1993 |
| WO | WO 95/08489 | A1 | 3/1995 |
| WO | WO 01/96205 | A1 | 12/2001 |
| WO | WO 2005/042370 | A1 | 5/2005 |
| WO | WO 2011/022145 | A1 | 2/2011 |
| WO | WO 2011/049947 | A1 | 4/2011 |

* cited by examiner

CARTON FOR ARTICLES

CROSS-REFERENCE TO RELATED APPLICATIONS

This application claims the benefit of U.S. Provisional Patent Application No. 63/335,903, filed on Apr. 28, 2022.

INCORPORATION BY REFERENCE

The disclosure of U.S. Provisional Patent Application No. 63/335,903, which was filed on Apr. 28, 2022, is hereby incorporated by reference for all purposes as if presented herein in its entirety.

BACKGROUND OF THE DISCLOSURE

The present disclosure generally relates to cartons for holding beverage containers or other types of articles. More specifically, the present disclosure relates to cartons having corner features that help protect the containers or articles from breakage.

SUMMARY OF THE DISCLOSURE

In general, one aspect of the disclosure is directed to a carton for containing plurality of articles. The carton can comprise a plurality of panels that extends at least partially around an interior of the carton. The plurality of panels can comprise a side panel. A plurality of end flaps can be respectively foldably connected to respective panels of the plurality of panels. The plurality of end flaps can at least partially form a closed end of the carton, and the plurality of end flaps can comprise a side end flap. A bevel panel can extend along a corner of the carton so that the side end flap is at least partially connected to the side panel by the bevel panel. The bevel panel can comprise features that are shaped and located at the corner according to geometric aspects of one or more articles of the plurality of articles.

In another aspect, the disclosure is generally directed to a package comprising a carton and a plurality of articles at least partially contained within the carton. The carton can comprise a plurality of panels that extends at least partially around an interior of the carton. The plurality of panels can comprise a side panel. A plurality of end flaps can be respectively foldably connected to respective panels of the plurality of panels. The plurality of end flaps can at least partially form a closed end of the carton, and the plurality of end flaps can comprise a side end flap. A bevel panel can extend along a corner of the carton so that the side end flap is at least partially connected to the side panel by the bevel panel. The bevel panel can comprise features that are shaped and located at the corner according to geometric aspects of one or more articles of the plurality of articles. The one or more articles can be positioned at the corner of the carton.

In another aspect, the disclosure is generally directed to a blank for forming a carton for containing a plurality of articles. The blank can comprise a plurality of panels comprising a side panel and a plurality of end flaps respectively foldably connected to respective panels of the plurality of panels. The plurality of end flaps can be for at least partially forming a closed end of the carton formed from the blank, and the plurality of end flaps can comprise a side end flap. A bevel panel can at least partially connect the side end flap to the side panel. The bevel panel can be for extending along a corner of the carton formed from the blank. The bevel panel can comprise features that are shaped and located in the blank according to geometric aspects of one or more articles of the plurality of articles.

In another aspect, the disclosure is generally directed to a method of forming a carton containing a plurality of articles. The method can comprise obtaining a blank comprising a plurality of panels, a plurality of end flaps respectively foldably connected to respective panels of the plurality of panels, and a bevel panel. The plurality of panels can comprise a side panel, the plurality of end flaps can comprise a side end flap, and the bevel panel can at least partially connect the side end flap to the side panel. The method further can comprise at least partially forming an interior of the carton by positioning the plurality of panels to extend at least partially around the interior and forming an at least partially closed end of the carton by at least partially overlapping the plurality of end flaps. The forming the at least partially closed end of the carton can comprise folding the side end flap relative to the side panel to position the bevel panel along a corner of the carton. The bevel panel can comprise features that are shaped and located in the blank according to geometric aspects of one or more articles of the plurality of articles.

Other aspects, features, and details of the present disclosure can be more completely understood by reference to the following detailed description of exemplary embodiments taken in conjunction with the drawings and from the appended claims.

Those skilled in the art will appreciate the above stated advantages and other advantages and benefits of various additional embodiments reading the following detailed description of the embodiments with reference to the below-listed drawing figures. Further, the various features of the drawings discussed below are not necessarily drawn to scale. Dimensions of various features and elements in the drawings may be expanded or reduced to more clearly illustrate the embodiments of the disclosure.

BRIEF DESCRIPTION OF THE DRAWINGS

Corresponding parts are designated by corresponding reference numbers throughout the drawings.

DETAILED DESCRIPTION OF THE EXEMPLARY EMBODIMENTS

The present disclosure generally relates to cartons that contain a single article or a plurality of articles such as containers, bottles, cans, etc., and protection features of such cartons that protect the article or articles or containers from breakage, damage, or deformation. The article(s) can be used for packaging food and beverage products, for example, or any other item. The article(s) can be made from materials suitable in composition for packaging the particular food or beverage item, or other item, and the materials can include, but are not limited to, glass or other breakable material; aluminum and/or other metals; plastics such as PET, LDPE, LLDPE, HDPE, PP, PS, PVC, EVOH, and Nylon; paperboard; and the like, or any combination thereof, or any other suitable material.

Cartons according to the present disclosure can accommodate articles of any shape. For the purpose of illustration and not for the purpose of limiting the scope of the disclosure, the following detailed description describes beverage containers (e.g., glass beverage bottles) as disposed within the carton embodiments. In this specification, the terms "inner," "outer," "interior," "exterior," "lower," "bottom," "upper," and "top" indicate orientations determined in relation to fully erected and upright cartons. As described herein, constructs can be formed with multiple walls, panels, portions, tabs, flaps, and/or other aspects, which may be designated herein in terms relative to one another, e.g., "first", "second", "third", etc., in sequential or nonsequential reference, without departing from the disclosure.

Figure 1:
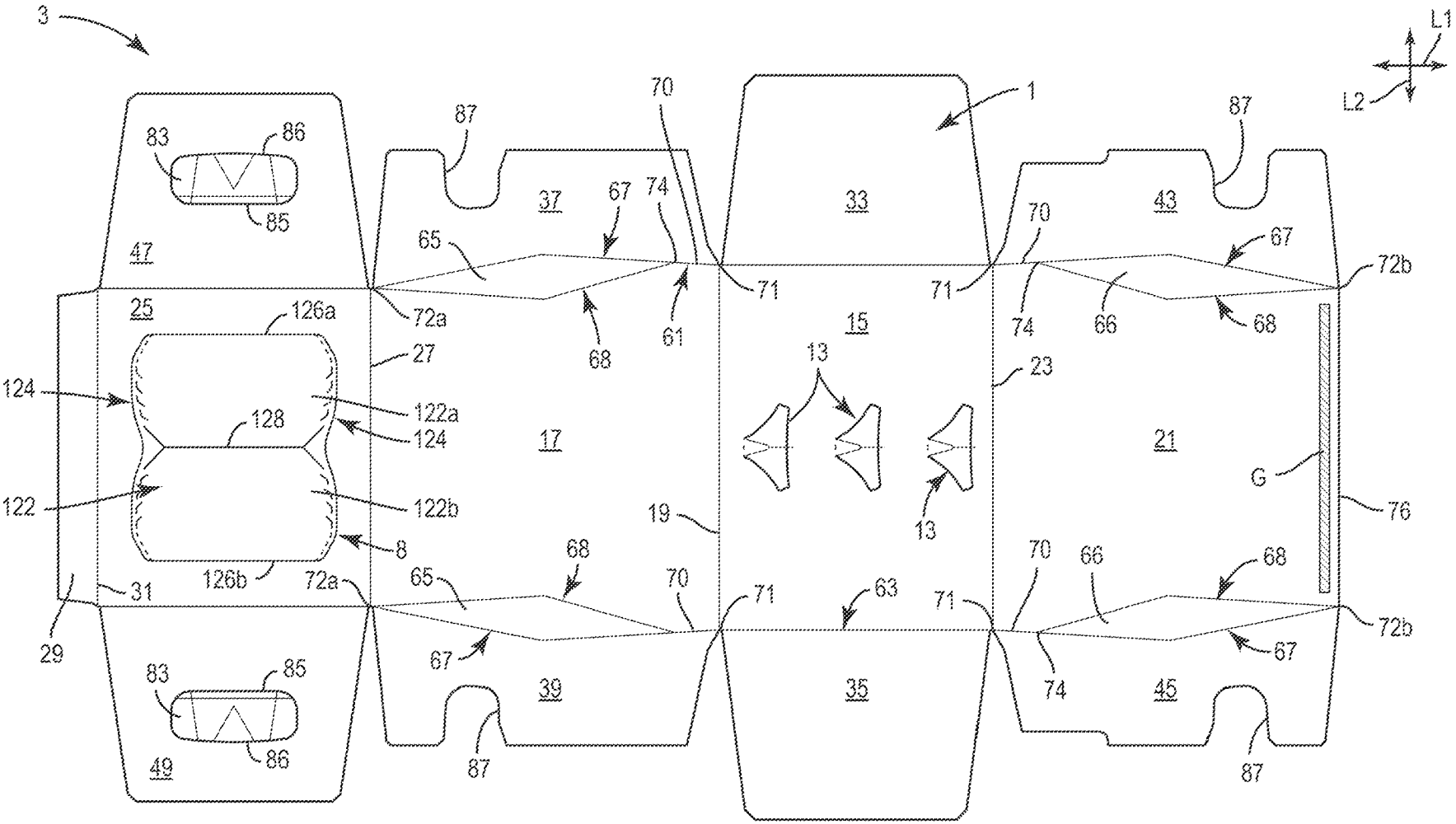
FIG. 1 is a plan view of an exterior surface of a blank for forming a carton according to exemplary embodiments of the disclosure.
Figure 3:
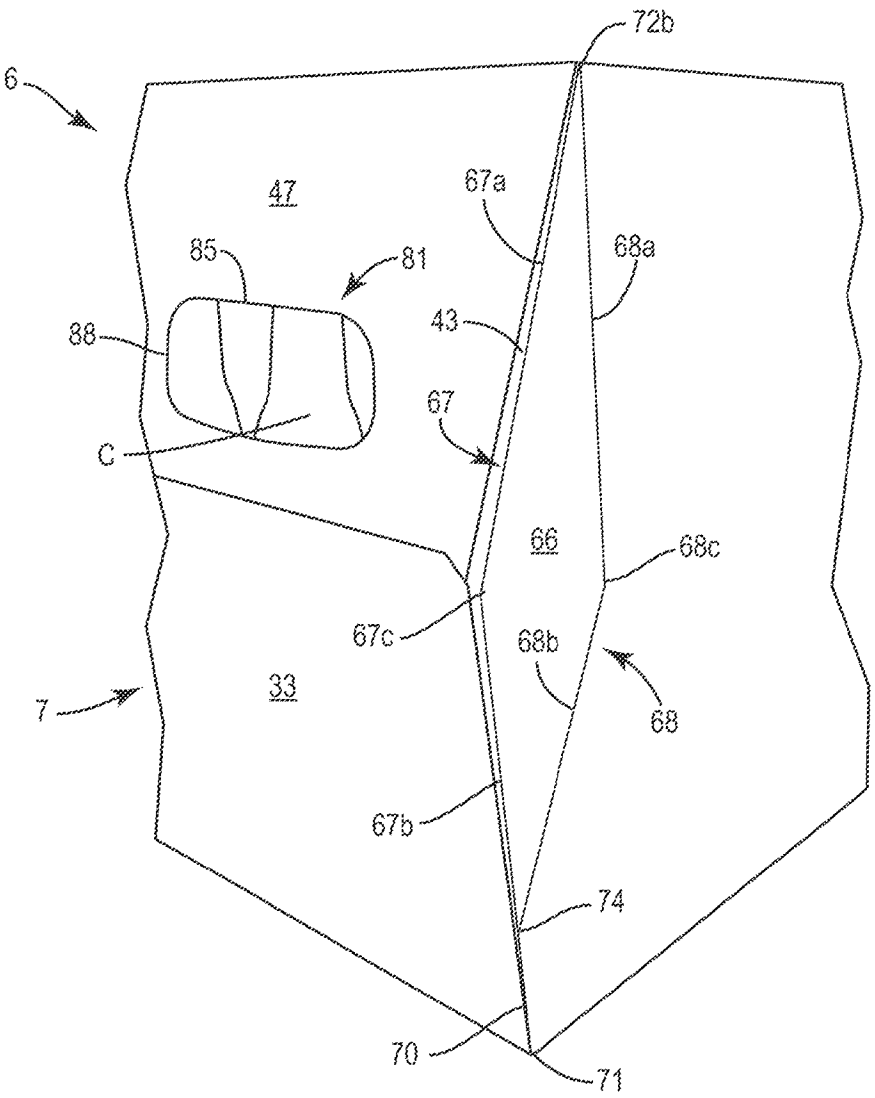
FIG. 3 is a perspective view of the carton formed from the blank of FIG. 1 according to exemplary embodiments of the disclosure.
Figure 4B:
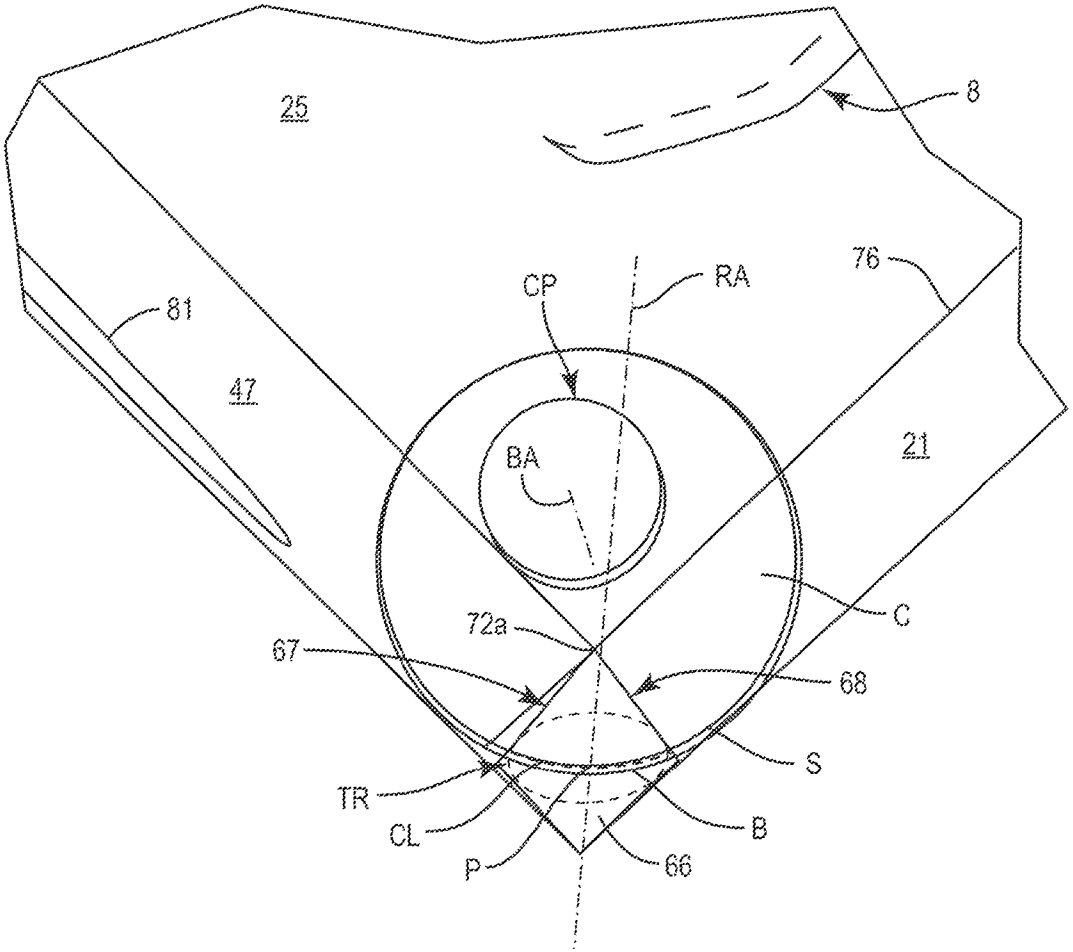
FIG. 4B is top perspective view of a corner of the carton of FIG. 3 with a container of FIG. 4A schematically shown and with other schematic information shown according to exemplary embodiments of the disclosure.

FIG. 1 is a plan view of the exterior side 1 of a blank, generally indicated at 3, used to form a carton 5 (FIG. 3) according to exemplary embodiments of the disclosure. The carton 5 can be used to house a plurality of articles such as containers C (FIGS. 3 and 4A) to form a package 6 (FIG. 3). In the illustrated embodiment, the containers C are bottles having a wide bottom B and a narrow top T including a cap CP (FIG. 4B). In the illustrated embodiment, the carton 5 is sized to house twelve containers C in a single layer in a 3×4 arrangement, but it is understood that the carton 5 may be sized and shaped to hold containers of a different or same quantity in more than one layer and/or in different row/column arrangements (e.g., 1×6, 2×6, 4×6, 3×8, 2×6×2, 3×4×2, 2×9, 3×6, etc.), or just a single article.

In one embodiment, the carton 5 may have article protection flaps 13 for protecting the at least one article C, which can be moveable between a first position and a second position placed between adjacent containers C in the carton to reduce movement of the containers in the carton and prevent breakage of the containers. The carton 5 can have other features (e.g., handle, dispenser, etc.) without departing from the disclosure.

The blank 3 has a longitudinal axis L1 and a lateral axis L2. In the embodiment of FIG. 1, the blank includes a bottom panel 15 foldably connected to a first side panel 17 at a lateral fold line 19. A second side panel 21 is foldably connected to the bottom panel 15 at a lateral fold line 23. A top panel 25 is foldably connected to the first side panel 17 at a lateral fold line 27, and foldably connected to an attachment panel 29 at a lateral fold line 31. Alternatively, the attachment panel 29 could be foldably connected to the second side panel 21 for being adhered to the top panel 25 to form the carton. In another alternative, the blank 3 could include a second top panel (not shown) foldably connected to the second side panel 21 for being overlapped by the first top panel 25 to form the carton.

The bottom panel 15 is foldably connected to a first bottom end flap 33 and a second bottom end flap 35. The first side panel 17 is foldably connected to a first side end flap 37 and a second side end flap 39. The second side panel 21 is foldably connected to a first side end flap 43 and a second side end flap 45. The top panel 25 is foldably connected to a first top end flap 47 and a second top end flap 49. In embodiments, when the carton 5 is erected, the end flaps 33, 37, 43, 47 close the first end 7 (FIG. 3) of the carton, and the end flaps 35, 39, 45, 49 close the second end (not shown) of the carton. In accordance with an alternative embodiment of the present disclosure, different flap arrangements can be used for closing the ends of the carton 5.

The end flaps 33, 37, 43, 47 extend along a first marginal area of the blank 3 and are foldably connected at a first longitudinal fold line 61 that extends along the length of the blank. The end flaps 35, 39, 45, 49 extend along a second marginal area of the blank 3 and are foldably connected at a second longitudinal fold line 63 that also extends along the length of the blank. The longitudinal fold lines 61, 63 may be, for example, substantially straight, or offset at one or more locations to account for blank thickness or for other factors.

Figure 2:
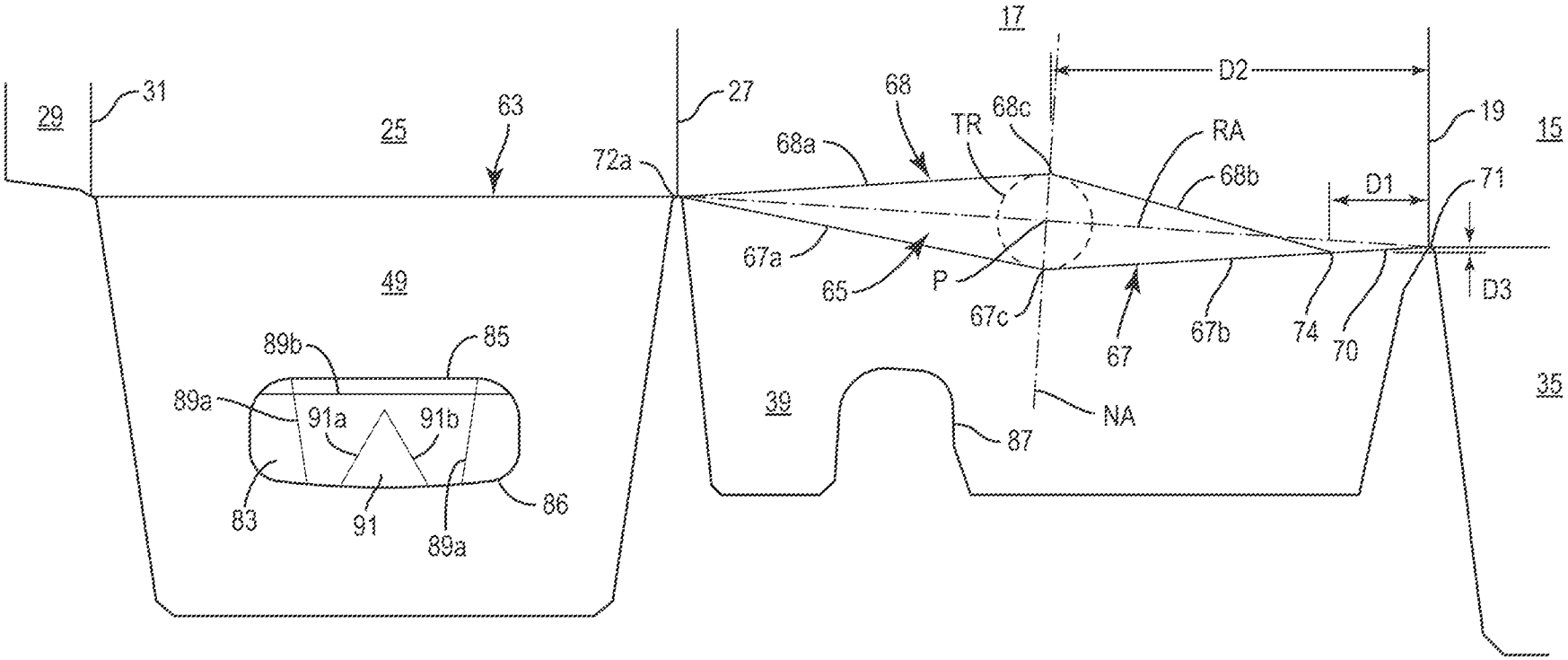
FIG. 2 is an enlarged portion of FIG. 1 with schematic information relating a bevel panel of the blank to features of a container according to exemplary embodiments of the disclosure.

In the illustrated embodiment, the side panels 17, 21 can have respective bevel panels 65, 66 at the ends of the side panels 17, 21, along portions of the side end flaps 37, 39, 43, 45 (FIGS. 1 and 2). In an exemplary embodiment, each of the bevel panels 65, 66 can be formed by bevel fold lines 67, 68, wherein one or both of the bevel fold lines 67, 68 can be considered portions of the longitudinal fold lines 61, 63 or can be considered to be interrupting the longitudinal fold lines 61, 63. For example, the bevel fold lines 67 can be considered portions of the longitudinal fold lines 61, 63, and the bevel fold lines 68 can be spaced inwardly in the side panels 17, 21 from the bevel fold lines 67/longitudinal fold lines 61, 63. In the illustrated embodiment, the bevel panels 65 are foldably connected to the side panel 17 along the respective inner bevel fold lines 68 and are foldably connected to the respective side end flaps 37, 39 along the respective outer bevel fold lines 67. Similarly, the bevel panels 66 are foldably connected to the side panel 21 along the respective inner bevel fold lines 68 and are foldably connected to the respective side end flaps 43, 45 along the respective outer bevel fold lines 67.

In embodiments, the ends of the carton, including the first end 7, are tapered ends, wherein the top panel 25 is shorter than the bottom panel 15 in the lateral direction L2 (e.g., the portions of the fold lines 61, 63 connecting the top end flaps 47, 49 to the top panel 25 are closer to the center of the carton 5 than the portions of the fold lines 61, 63 connecting the bottom end flaps 33, 35 to the bottom panel 15). In exemplary embodiments, the tapered ends allow a tight fit of the containers C in the carton 5. In embodiments, the side end flaps 37, 39, 43, 45 can be angled inwardly at the bevel panels 65, 66 at the tapered ends of the carton 5. The bevel panels 65, 66 and/or the taper of the ends of the carton 5 can help secure the containers C within the carton 5 to help reduce or eliminate movement of the containers C in the carton to reduce or eliminate damage to the containers during handling of the package 6 as described in more detail below. The ends of the carton 5 could be otherwise shaped, arranged, and/or configured (e.g., straight or non-tapered) without departing from the disclosure.

As shown in FIGS. 1 and 2, each of the outer (first) bevel fold lines 67 includes an upper (first) portion or segment 67*a* and a lower (second) portion or segment 67*b*, and each of the inner (second) bevel fold lines 68 includes an upper (first) portion or segment 68*a* and a lower (second) portion or segment 68*b*. As shown in FIGS. 1 and 2, the outer segments 67*a*, 67*b* of the outer bevel fold lines 67 intersect at an outer vertex 67*c* and extend at an obtuse angle from the outer vertex 67*c* so that the outer segments 67*a*, 67*b* are concave along the respective bevel panel 65, 66 and are convex with respect to the respective side end flaps 37, 39, 43, 45. Similarly, the inner segments 68*a*, 68*b* of the inner bevel fold lines 68 intersect at an inner vertex 68*c* and extend at an obtuse angle from the inner vertex 68*c* so that the inner segments 68*a*, 68*b* are concave along the respective bevel panel 65, 66 and are convex with respect to the respective side panels 17, 21. As shown in FIGS. 1 and 2, the upper segments 67*a*, 68*a* are oblique with respect to one another and with respect to the respective lower segments 67*b*, 68*b*, and the lower segments 67*b*, 68*b* are oblique with respect to one another. In embodiments, the segments of the fold lines 67, 68 are angled and cooperate so that the connecting panels 65, 66 generally are in the form of diamond corner panels. In the illustrated embodiment, the lower segment 67*b* of the outer bevel fold line 67 can extend from a side segment 70 of the respective longitudinal fold lines 61, 63 extending from respective bottom corner vertices 71 of the bottom panel 15 to the respective bevel panel 65, 66. In embodiments, the bottom corner vertices 71 of the bottom panel 15 are formed at an intersection between the respective longitudinal fold line 61, 63 and the respective lateral fold line 19, 23. In an exemplary embodiment, the lower segment 67*b* can be collinear with the side segment 70. In the illustrated embodiment, each of the segments 67*a*, 67*b*, 68*a*, 68*b* is oblique with each of the other segments, and the segments cooperate so that the bevel panels 65, 66 are in the shape of diamonds and form diamond corner panels.

In embodiments, the top ends of the bevel fold lines 67, 68 of the bevel panels 65 can intersect or end adjacent one another at or adjacent a respective end of the lateral fold line 27 adjacent or abutting the top panel 25. In the illustrated embodiment, the upper segments 67*a*, 68*a* of the bevel panels 65 can meet with the lateral fold line 27 and the portion of the longitudinal fold line 61, 63 extending along the top panel 25 at an upper intersection 72*a* (e.g., which can correspond to a top corner vertex of the carton when it is formed as shown in FIGS. 3 and 4B). As shown in FIG. 1, the top ends of the bevel fold lines 67, 68 of the bevel panels 66 can intersect or end adjacent one another at or adjacent a free edge 76 of the second side panel 21 that is adjacent the top panel 25 when the carton is erected. In the illustrated embodiment, the upper segments 67*a*, 68*a* of the bevel panels 66 can meet with the free edge 76 at an upper intersection 72*b* (e.g., which can correspond to a top corner vertex of the carton when it is formed). As shown in FIGS. 1 and 2, the lower segments 67*b*, 68*b* of the bevel fold lines 67, 68 of the bevel panels 65, 66 can intersect or end adjacent one another at or adjacent an end of the respective side segment 70 to form a lower intersection 74. In the illustrated embodiment, the lower intersections 74 can be spaced from the bottom panel 15 (e.g., from the respective ends of the respective lateral fold lines 19, 23 at the bottom corner vertices 71) by a distance D1 (FIG. 2), which can be equal to the length of the side segments 70. Accordingly, in the exemplary embodiment, the bevel panels 65, 66 are spaced apart from the bottom panel 15 to form suspended diamond corner panels in the erected carton.

The bevel panels 65, 66 could be omitted or could be otherwise shaped, arranged, configured, and/or positioned without departing from the disclosure. For example, the lower segments 67*b* of the outer bevel fold lines 67 could be oblique with respect to the side segments 70 of the longitudinal fold lines 61, 63.

In the embodiment of FIG. 1, the blank 3 has handle features for forming a handle 81 (FIG. 3) in the closed ends of the carton 5. In embodiments, each of the handles 81 can comprise a handle flap 83 foldably connected to the respective top end flap 47, 49 along a respective fold line 85. The handle flaps 83 can be separable from the respective top end flap 47, 49 along respective cut or tear lines 86. In embodiments, the handle flaps 83 can be connected to the respective top end flap 47, 49 by one or more breakable nicks arranged along the cut line 68, wherein the nicks can help hold the handle flaps 83 in place until the handles 83 are intentionally actuated by a user. The handles 81 can also include a cutout 87 in each of the side end flaps 37, 43 and 39, 45 that are overlapped by the respective handle flaps 83 in the handles 81. Accordingly, the cutouts 87 can provide clearance in the side end flaps for folding the handle flaps 83 inwardly in the carton.

As shown in FIGS. 1 and 2, the handle flaps 83 can include features that can help the handle flaps fold around the containers C in the interior of the carton when the handle flaps 83 are folded inwardly to form a handle opening 88 (FIG. 3). For example, as shown in FIG. 2, the handle flaps 83 can include oblique lines 89*a* (e.g., cut-crease lines or other suitable lines) that help allow the ends of the handle flaps 83 to fold relative to a central portion of the handle flaps when the ends are pressed against the containers C and a longitudinal line 89*b* (e.g., a cut-crease line or other suitable line) that can help form a more comfortable (e.g., wider) gripping area of the handle flaps when a user carries the carton 5 at the handle 81. As shown in FIG. 2, the handle flaps 83 can include a fold-away tab 91 (e.g., a triangular tab) that is foldably connected to the handle flap 83 along an oblique fold line 91*a* and is separable from the handle flap 83 along a cut or tear line 91*b*. In embodiments, the fold-away tab 91 can be connected to the handle flap 83 by one or more breakable nicks arranged along the cut line 91*b*. In the illustrated embodiment, the fold-away tab 91 can be separable from the top end flap along the cut line 86.

When the handle 81 is actuated for carrying the carton 5, the fold-away tabs 91 can break away from the handle flaps 83 and the top end flaps 47, 49 along the cut lines 91*b*, 86 and can fold along the oblique fold lines 91*a* (either inwardly or outwardly) to provide clearance for a container C adjacent the handle 81 in the interior of the carton 5. Any of the handle features could be omitted or could be otherwise shaped, arranged, configured, and/or positioned without departing from the disclosure.

As shown in FIG. 1, the blank 3 includes one or more (e.g., three) article protection flaps 13 arranged in the bottom panel 15. The article protection flaps 13 could be similar to or different than the article protection flaps shown and described in U.S. patent application Ser. No. 13/419,740. The article protection flaps 13 could be omitted or could be otherwise shaped, arranged, configured, and/or positioned without departing from the scope of this disclosure. For example, the flaps could be otherwise arranged in other suitable row/column arrangements or in a random configuration on the bottom panel 15, including a single row configuration, a single column configuration, multiple rows and/or columns configurations, or any other suitable configuration.

In the illustrated embodiment, the blank 3 has features (FIG. 1) for forming a dispenser 8 in the carton 5 (partially shown in FIG. 4). In one embodiment, the dispenser 8 comprises a dispenser panel 122 in the top panel 25 that is defined by tear lines 124. In one the dispenser panel 122 has a first portion 122*a* and a second portion 122*b* that are foldably connected to the top panel at respective fold lines 126*a*, 126*b*. The tear lines 124 extend between the fold lines 126*a*, 126*b* and are configured to allow separation of the first portion 122*a* and the second portion 122*b* from the top panel 25 as they are folded along the respective fold lines 126*a*, 126*b*. As shown in FIG. 1, the portions 122*a*, 122*b* can be separable from one another along a cut line 128 and can be partially connected along breakable nicks arranged along the cut line 128. In the erected carton 5, the dispenser 8 can be actuated (e.g., by tearing along the tear lines 124 and the cut line 128 and folding the portions 122*a*, 122*b* along the fold lines 126*a*, 126*b*) to form a dispenser opening (not shown) for accessing the interior of the carton 5 and selectively removing the containers C from the carton. The dispenser 8 could be omitted or could be otherwise shaped, arranged, configured and/or, positioned without departing from the disclosure.

In an exemplary embodiment, the blank 3 can be formed into a sleeve (not shown) having open ends (not shown) by folding the bottom panel 15, side panels 17, 21, and top panel 25 along respective fold lines 19, 23, 27, 31. The attachment panel 29 can be adhesively secured to the second side panel 21 by glue or other suitable adhesive (e.g., glue strip G shown in FIG. 1). The containers C can be placed into an interior space of the sleeve, and the ends of the sleeve can be closed by folding the end flaps 33, 37, 43, 47 over the first end 7 (FIG. 3) and folding the end flaps 35, 39, 45, 49 over the second end (not shown) and gluing the overlapped end flaps together at the respective ends. When the top end flaps 47, 49 overlap the respective side end flaps 37, 43 and 39, 45, the handle flaps 83 are aligned with the handle cutouts 87 to form the handles 81 at each end. One of the first end 7 and second end (not shown) can be closed prior to loading the containers C or both of the ends can be closed after loading the containers into the interior space.

For example, as shown in FIG. 3, the first end 7 is closed by first inwardly folding the side end flaps 37, 43 and then folding the top end flap 47 and the bottom end flap 33 over the end to overlap the side end flaps. In the illustrated embodiment, the bevel panels 65, 66 are folded over the containers C at the corners of the carton to extend at an angle with respect to the respective side panels 17, 21 and the respective side end flaps 37, 43. Accordingly, the bevel panels 65, 66 can be positioned at the corners of the carton 5 so that they are pulled tightly against the respectively adjacent containers C at the corners of the carton. As shown in FIG. 3, the lower intersection 74 of the bevel panels 66 at the first end 7 is spaced apart from the bottom panel 15 (e.g., by the distance D1) when the side end flaps 37, 43 are folded over the end 7. The bevel panels 65, 66, and/or the fold lines 67, 68 could be omitted or could be otherwise shaped, arranged, configured, and/or positioned without departing from the disclosure.

As shown in FIG. 3, the top end flap 47 is downwardly folded and partially overlapped with and glued to the side end flaps 37, 43 and the bottom end flap 33 is upwardly folded and partially overlapped with and glued to the side end flaps 37, 43 and the top end flap 47 to close the end 7 of the carton 5. The second end (not shown) can be closed in a similar manner as the first end 7. Alternatively, the second end could have different flap closing sequence or arrangement.

Figure 4A:
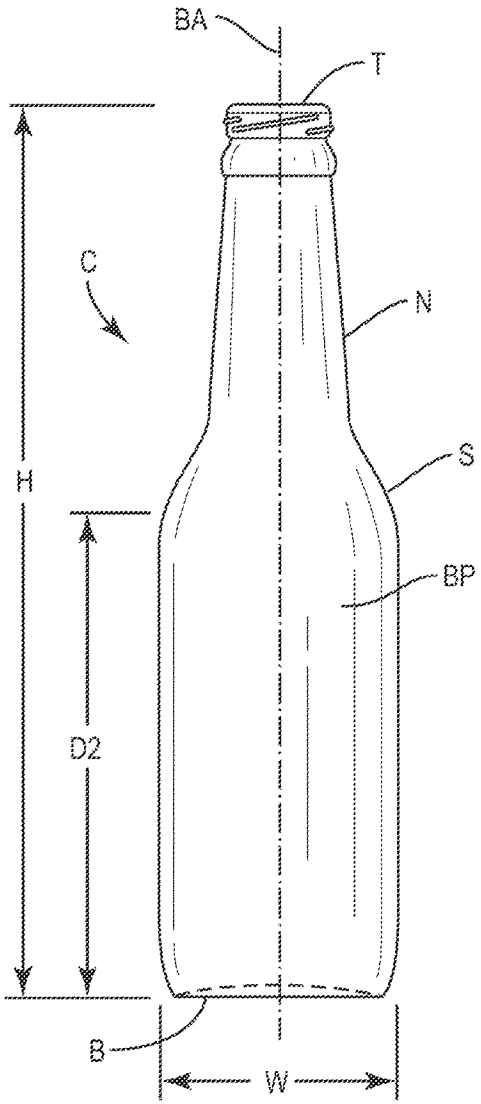
FIG. 4A is a schematic elevation view of a container to be held in the carton of FIG. 3 according to exemplary embodiments of the disclosure.

As shown in FIG. 4A and as discussed above, the containers C can be bottles or other suitable containers that are cylindrical (e.g., partially cylindrical, somewhat cylindrical, generally cylindrical, approximately cylindrical, substantially cylindrical, etc. or that have any other suitable shape) with a central axis BA extending along its height (FIGS. 4A and 4B) and that have a secondary taper or otherwise have a narrower top T and wider bottom B. Such containers C located at the corners of the carton 5 can have a shoulder contact sphere in relation to the carton material (e.g., paperboard or another suitable semi-flexible material) when the carton, including the respective bevel panels 65, 66, is folded about the corner containers C. The carton 5, including the bevel panels 65, 66 can be configured in reference to the shoulder contact sphere to help provide a snug fit about the containers C to protectively cradle the containers C and reduce or prevent movement of the containers C in the package 6. The shoulder contact sphere of each of the corner containers C can have an apex on the surface of the container at a shoulder height D2 of the shoulder S at its maximum diameter. As shown in FIG. 4A, the shoulder height D2 can be measured from the bottom B to the height of the container C where the shoulder S is at its maximum diameter (e.g., the container C can have a reduced diameter, such as by a taper, a ledge, or other suitable feature, above the maximum diameter of the shoulder S and the container can have a similar diameter or reduced diameter below the shoulder height). In exemplary embodiments, the radius of the shoulder contact sphere can be half of the radius (e.g., the maximum radius) of the container C (e.g., a quarter of the width W shown in FIG. 4A).

In the illustrated embodiment, the top corner vertices of the carton (e.g., at the upper intersections 72*a*, 72*b*) are offset from the bottom corner vertices 71 of the carton C to cooperate with the bevel panels 65, 66 to help protectively cradle the containers C and reduce or prevent movement of the containers C in the package 6. For example, the bottom corner vertices 71 can be configured to be proximate to (or to be in contact with or adjacent to) the bottom circumference of the respective corner containers C, and the top corner vertices of the carton C can be configured to be proximate to (or to be in contact with or adjacent to) the top circumference of the respective corner containers C (or their caps CP). As discussed above, in the illustrated embodiment, the bottom panel 15 is larger than the top panel 25 (and the bottom corner vertices 71 are offset outwardly from the top corner vertices) because the containers C have narrower tops T and wider bottoms B.

In embodiments, the features of the bevel panels 65, 66 can be located and shaped according to the geometry of the containers C (e.g., according to geometric aspects of the containers C) by identifying a diamond tangential radius TR, a rolling axis RA, and a normal axis NA in relation to the top corner vertices and bottom corner vertices of the carton 5. As shown in FIGS. 2 and 4B, the shoulder contact sphere of the container C can be schematically represented on the blank 3 and the carton 5 by the diamond tangential radius TR, which can be schematically drawn as a circle or other suitable shape centered on a point P and having a characteristic dimension (e.g., a radius) that is approximately half of the radius (e.g., the maximum radius) of the container C. In embodiments, the point P can correspond to the apex of the shoulder contact sphere of the container C at the respective corner of the carton. Accordingly, the point P can be located at the distance D2 from the bottom corner vertex 71 (FIG. 2). The point P also can be located on the rolling axis RA, which can be schematically drawn as a straight line extending from the top corner vertex of the top panel 25 (e.g., intersection 72*a*, 72*b*) to the bottom corner vertex 71 of the bottom panel 15. Stated another way, the rolling axis can be a linear connective segment between the upper and lower intersection points for the top panel corner vertices and bottom panel corner vertices. As shown in FIG. 2, the normal axis NA can be schematically drawn as a straight line extending perpendicular to the rolling axis RA and extending through the point P. In embodiments, the contact line CL where the container C contacts the diamond corner panel 65 or 66 in the diamond tangential radius TR can intersect the rolling axis RA at the point P, as shown in FIG. 4B.

As shown in FIG. 2, the bevel fold lines 67, 68 can be positioned so that the vertices 67*c*, 68*c* are located at the points where the normal axis NA intersects with the boundary (e.g., circumference) of the diamond tangential radius TR. Accordingly, the upper segments 67*a*, 68*a* can extend tangentially from the diamond tangential radius TR at the respective vertices 67*c*, 68*c* to the upper intersection 72*a*, and the lower segments 67*b*, 68*b* can extend tangentially from the diamond tangential radius TR at the respective vertices 67*c*, 68*c* to the lower intersection 74. In embodiments, the distance D1 that the lower intersection 74 is spaced from the bottom corner vertex 71 can be determined as a percentage of the height H (FIG. 4A) of the container C. For example, the distance D1 could be approximately within 0.125 inches of 12.5% of the height H of the container C or any suitable percentage. In embodiments, the lower intersection 74 also can be offset from the bottom corner vertex 71 in the lateral direction L2 by a distance D3 (e.g., by approximately 0.0625 inch or any suitable distance). In embodiments, the offset distance D3 can be determined by the location of the intersection 74 (e.g., at distance D1) and the angle of the lower segment 67*b* and the side segment 70 (e.g., wherein the lower segment 67*b* and the side segment 70 can be collinear). The angle of the lower segment 67*b* and the side segment 70 can be determined by the position of the outer vertex 67*c*, which can be determined by the orientation of the rolling axis RA and the normal axis NA (e.g., the angle of the normal axis NA), the size of the tangential radius TR, and the position of the point P (e.g., at the distance D2 on the rolling axis RA).

With the bevel panels 65, 66 located and arranged in the corners of the package 6 as described, they can improve or optimize the snug fit of the carton 5 around the corner containers C to help protectively cradle and reduce or prevent movement of the containers C in the interior of the carton to help prevent or eliminate damage or breakage of the containers C.

The cartons of any of the illustrated or non-illustrated embodiments of the disclosure could have other features (e.g., dispenser features, handle features, reinforcement features, etc.) without departing from the disclosure. Also, the cartons could be otherwise shaped, arranged, and/or configured and the cartons could be configured to hold articles other than beverage containers C without departing from the disclosure.

Any of the features of the various embodiments of the disclosure can be combined with, replaced by, or otherwise configured with other features of other embodiments of the disclosure without departing from the scope of this disclosure. Further, it is noted that the bevel panels and/or the article protection features of the various embodiments can be incorporated into a carton having any carton style or panel configuration. The carton styles and panel configurations described above are included by way of example.

In general, the blanks of any of the illustrated or non-illustrated embodiments may be constructed from paperboard having a caliper so that it is heavier and more rigid than ordinary paper. The blank can also be constructed of other materials, such as cardboard, or any other material having properties suitable for enabling the carton to function at least generally as described above. The blank can be coated with, for example, a clay coating. The clay coating may then be printed over with product, advertising, and other information or images. The blanks may then be coated with a varnish to protect information printed on the blanks. The blanks may also be coated with, for example, a moisture barrier layer, on either or both sides of the blanks. The blanks can also be laminated to or coated with one or more sheet-like materials at selected panels or panel sections.

As an example, a tear line can include: a slit that extends partially into the material along the desired line of weakness, and/or a series of spaced apart slits that extend partially into and/or completely through the material along the desired line of weakness, or various combinations of these features. As a more specific example, one type of tear line is in the form of a series of spaced apart slits that extend completely through the material, with adjacent slits being spaced apart slightly so that a nick (e.g., a small somewhat bridging-like piece of the material) is defined between the adjacent slits for typically temporarily connecting the material across the tear line. The nicks are broken during tearing along the tear line. The nicks typically are a relatively small percentage of the tear line, and alternatively the nicks can be omitted from or torn in a tear line such that the tear line is a continuous cut line. That is, it is within the scope of the present disclosure for each of the tear lines to be replaced with a continuous slit, or the like. For example, a cut line can be a continuous slit or could be wider than a slit without departing from the present disclosure.

In accordance with the exemplary embodiments, a fold line can be any substantially linear, although not necessarily straight, form of weakening that facilitates folding there along. More specifically, but not for the purpose of narrowing the scope of the present disclosure, fold lines include: a score line, such as lines formed with a blunt scoring knife, or the like, which creates a crushed or depressed portion in the material along the desired line of weakness; a cut that extends partially into a material along the desired line of weakness, and/or a series of cuts that extend partially into and/or completely through the material along the desired line of weakness; and various combinations of these features. In situations where cutting is used to create a fold line, typically the cutting will not be overly extensive in a manner that might cause a reasonable user to incorrectly consider the fold line to be a tear line.

The above embodiments may be described as having one or more panels adhered together by glue during erection of the carton embodiments. The term "glue" is intended to encompass all manner of adhesives commonly used to secure carton panels in place.

The foregoing description of the disclosure illustrates and describes various embodiments. As various changes could be made in the above construction without departing from the scope of the disclosure, it is intended that all matter contained in the above description or shown in the accompanying drawings shall be interpreted as illustrative and not in a limiting sense. Furthermore, the scope of the present disclosure covers various modifications, combinations, alterations, etc., of the above-described embodiments. Additionally, the disclosure shows and describes only selected embodiments, but various other combinations, modifications, and environments are within the scope of the disclosure as expressed herein, commensurate with the above teachings, and/or within the skill or knowledge of the relevant art. Furthermore, certain features and characteristics of each embodiment may be selectively interchanged and applied to other illustrated and non-illustrated embodiments of the disclosure.

The invention claimed is:

1. A carton for containing plurality of articles, the carton comprising:

a plurality of panels that extends at least partially around an interior of the carton, the plurality of panels comprising a side panel;

a plurality of end flaps respectively foldably connected to respective panels of the plurality of panels, the plurality of end flaps at least partially forming a closed end of the carton, the plurality of end flaps comprising a side end flap; and a bevel panel extending along a corner of the carton so that the side end flap is at least partially connected to the side panel by the bevel panel, wherein the bevel panel comprises features that are shaped and located at the corner according to geometric aspects of one or more articles of the plurality of articles, the one or more articles positioned at the corner of the carton;

wherein a rolling axis of the corner of the carton extends from an upper intersection of the bevel panel to a bottom corner vertex of the carton, a normal axis of the corner is perpendicular to the rolling axis, and an inner vertex and an outer vertex are located on the normal axis;

wherein the one or more articles has a shoulder at a shoulder height from a bottom end of the one or more articles, the normal axis intersects the rolling axis at a point that is spaced apart from the bottom corner vertex of the carton by the shoulder height of the shoulder of the one or more articles; and wherein each of the outer vertex and the inner vertex is spaced apart from the point where the normal axis intersects the rolling axis by a tangential radius, the tangential radius being approximately one half of a radius of the one or more articles at the shoulder.

2. The carton of claim 1, wherein the plurality of panels comprises a bottom panel foldably connected to the side panel, and the bevel panel is spaced apart from the bottom panel by at least a side segment of a longitudinal fold line, the side end flap being foldably connected to the side panel along at least the side segment.

3. The carton of claim 2, wherein the plurality of panels comprises a top panel opposite to the bottom panel, and the bevel panel extends from the top panel to the side segment.

4. The carton of claim 1, wherein the bevel panel is foldably connected to the side end flap along an outer bevel fold line and is foldably connected to the side panel along an inner bevel fold line, the outer bevel fold line and the inner bevel fold line intersect at a lower intersection, and the side end flap is foldably connected to the side panel along at least a side segment of a longitudinal fold line, the side segment extending from the lower intersection of the bevel panel.

5. The carton of claim 4, wherein the outer bevel fold line comprises a first outer segment and a second outer segment, the inner bevel fold line comprises a first inner segment and a second inner segment, the first outer segment and the first inner segment converge at the upper intersection, and the second outer segment and the second inner segment converge at the lower intersection.

6. The carton of claim 1, wherein the bevel panel is foldably connected to the side end flap along an outer bevel fold line and is foldably connected to the side panel along an inner bevel fold line, the outer bevel fold line comprises a first outer segment and a second outer segment that intersect at the outer vertex, and the inner bevel fold line comprises a first inner segment and a second inner segment that intersect at the inner vertex.

7. The carton of claim 6, wherein the first outer segment and the first inner segment converge at the upper intersection of the bevel panel.

8. The carton of claim 7, wherein the outer vertex and the inner vertex are spaced apart from one another on the normal axis by half a width of the one or more articles.

9. The carton of claim 6, wherein the one or more articles has a top spaced from a bottom by an article height, and the second outer segment and the second inner segment converge at a lower intersection that is spaced apart from a bottom corner vertex of the carton by approximately 12.5% of the article height.

10. The carton of claim 1, wherein:

the side panel is a first side panel, the side end flap is a first side end flap, the bevel panel is a first bevel panel, and the corner is a first corner;

the plurality of panels further comprises a second side panel opposite to the first side panel;

the plurality of end flaps further comprises a second side end flap; and the carton further comprises a second bevel panel extending along a second corner of the carton so that the second side end flap is at least partially connected to the second side panel by the second bevel panel.

11. The carton of claim 10, wherein each of the first bevel panel and the second bevel panel comprises an upper intersection, a lower intersection, an outer vertex, an inner vertex, a rolling axis extending from the upper intersection to a respective bottom corner vertex of the carton, and a normal axis that is perpendicular to the rolling axis and that intersects with the rolling axis at a distance from the respective bottom corner vertex corresponding to a shoulder height of the one or more articles; wherein, for each of the first bevel panel and the second bevel panel, the outer vertex and the inner vertex are located on the normal axis.

12. A package comprising a carton and a plurality of articles at least partially contained within the carton, the carton comprising:

a plurality of panels that extends at least partially around an interior of the carton, the plurality of panels comprising a side panel;

a plurality of end flaps respectively foldably connected to respective panels of the plurality of panels, the plurality of end flaps at least partially forming a closed end of the carton, the plurality of end flaps comprising a side end flap; and a bevel panel extending along a corner of the carton so that the side end flap is at least partially connected to the side panel by the bevel panel, wherein the bevel panel comprises features that are shaped and located at the corner according to geometric aspects of one or more articles of the plurality of articles, wherein the one or more articles is positioned at the corner of the carton;

wherein a rolling axis of the corner of the carton extends from an upper intersection of the bevel panel to a bottom corner vertex of the carton, a normal axis of the corner is perpendicular to the rolling axis, and an inner vertex and an outer vertex are located on the normal axis;

wherein the one or more articles has a shoulder at a shoulder height from a bottom end of the one or more articles, the normal axis intersects the rolling axis at a point that is spaced apart from the bottom corner vertex of the carton by the shoulder height of the shoulder of the one or more articles; and wherein each of the outer vertex and the inner vertex is spaced apart from the point where the normal axis intersects the rolling axis by a tangential radius, the tangential radius being approximately one half of a radius of the one or more articles at the shoulder.

13. The package of claim 12, wherein the plurality of panels comprises a bottom panel foldably connected to the side panel, and the bevel panel is spaced apart from the bottom panel by at least a side segment of a longitudinal fold line, the side end flap being foldably connected to the side panel along at least the side segment.

14. The package of claim 13, wherein the plurality of panels comprises a top panel opposite to the bottom panel, and the bevel panel extends from the top panel to the side segment.

15. The package of claim 12, wherein the bevel panel is foldably connected to the side end flap along an outer bevel fold line and is foldably connected to the side panel along an inner bevel fold line, the outer bevel fold line and the inner bevel fold line intersect at the lower intersection, and the side end flap is foldably connected to the side panel along at least a side segment of a longitudinal fold line, the side segment extending from the lower intersection of the bevel panel.

16. The package of claim 15, wherein the outer bevel fold line comprises a first outer segment and a second outer segment, the inner bevel fold line comprises a first inner segment and a second inner segment, the first outer segment and the first inner segment converge at the upper intersection, and the second outer segment and the second inner segment converge at the lower intersection.

17. The package of claim 12, wherein the bevel panel is foldably connected to the side end flap along an outer bevel fold line and is foldably connected to the side panel along an inner bevel fold line, the outer bevel fold line comprises a first outer segment and a second outer segment that intersect at the outer vertex, and the inner bevel fold line comprises a first inner segment and a second inner segment that intersect at the inner vertex.

18. The package of claim 17, wherein the first outer segment and the first inner segment converge at the upper intersection of the bevel panel.

19. The package of claim 18, wherein the outer vertex and the inner vertex are spaced apart from one another on the normal axis by half a width of the one or more articles.

20. The package of claim 17, wherein the one or more articles has a top spaced from a bottom by an article height, and the second outer segment and the second inner segment converge at a lower intersection that is spaced apart from a bottom corner vertex of the carton by approximately 12.5% of the article height.

21. The package of claim 12, wherein:

the side panel is a first side panel, the side end flap is a first side end flap, the bevel panel is a first bevel panel, and the corner is a first corner;

the plurality of panels further comprises a second side panel opposite to the first side panel;

the plurality of end flaps further comprises a second side end flap; and the carton further comprises a second bevel panel extending along a second corner of the carton so that the second side end flap is at least partially connected to the second side panel by the second bevel panel.

22. The package of claim 21, wherein each of the first bevel panel and the second bevel panel comprises an upper intersection, a lower intersection, an outer vertex, an inner vertex, a rolling axis extending from the upper intersection to a respective bottom corner vertex of the carton, and a normal axis that is perpendicular to the rolling axis and that intersects with the rolling axis at a distance from the respective bottom corner vertex corresponding to a shoulder height of the one or more articles; wherein, for each of the first bevel panel and the second bevel panel, the outer vertex and the inner vertex are located on the normal axis.

23. A blank for forming a carton for containing a plurality of articles, the blank comprising:

a plurality of panels comprising a side panel;

a plurality of end flaps respectively foldably connected to respective panels of the plurality of panels, the plurality of end flaps being for at least partially forming a closed end of the carton formed from the blank, the plurality of end flaps comprising a side end flap; and a bevel panel at least partially connecting the side end flap to the side panel, the bevel panel being for extending along a corner of the carton formed from the blank, wherein the bevel panel comprises features that are shaped and located in the blank according to geometric aspects of one or more articles of the plurality of articles, the one or more articles for being positioned at the corner of the carton formed from the blank;

wherein a rolling axis of the corner of the carton formed from the blank extends from an upper intersection of the bevel panel to a bottom corner vertex of the bottom panel, a normal axis of the corner is perpendicular to the rolling axis, and an inner vertex and an outer vertex are located on the normal axis;

wherein the one or more articles has a shoulder at a shoulder height from a bottom end of the one or more articles, the normal axis intersects the rolling axis at a point that is spaced apart from the bottom corner vertex of the carton by the shoulder height of the shoulder of the one or more articles; and wherein each of the outer vertex and the inner vertex is spaced apart from the point where the normal axis intersects the rolling axis by a tangential radius, the tangential radius being approximately one half of a radius of the one or more articles at the shoulder.

24. The blank of claim 23, wherein the plurality of panels comprises a bottom panel foldably connected to the side panel, and the bevel panel is spaced apart from the bottom panel by at least a side segment of a longitudinal fold line, the side end flap being foldably connected to the side panel along at least the side segment.

25. The blank of claim 24, wherein the plurality of panels comprises a top panel for being positioned opposite to the bottom panel when the carton is formed from the blank, and the bevel panel extends from the top panel to the side segment.

26. The blank of claim 23, wherein:

the bevel panel is foldably connected to the side end flap along an outer bevel fold line and is foldably connected to the side panel along an inner bevel fold line, the outer bevel fold line comprises a first outer segment and a second outer segment that intersect at the outer vertex, the inner bevel fold line comprises a first inner segment and a second inner segment that intersect at the inner vertex, and the first outer segment and the first inner segment converge at the upper intersection.

27. The blank of claim 23, wherein:

the side panel is a first side panel, the side end flap is a first side end flap, the bevel panel is a first bevel panel, and the corner is a first corner;

the plurality of panels further comprises a second side panel for being disposed opposite to the first side panel when the carton is formed from the blank;

the plurality of end flaps further comprises a second side end flap; and the blank further comprises a second bevel panel extending along a second corner of the carton so that the second side end flap is at least partially connected to the second side panel by the second bevel panel.

28. A method for forming a carton containing a plurality of articles, the method comprising:

obtaining a blank comprising a plurality of panels, a plurality of end flaps respectively foldably connected to respective panels of the plurality of panels, and a bevel panel, the plurality of panels comprising a side panel, the plurality of end flaps comprising a side end flap, and the bevel panel at least partially connecting the side end flap to the side panel;

at least partially forming an interior of the carton by positioning the plurality of panels to extend at least partially around the interior; and forming an at least partially closed end of the carton by at least partially overlapping the plurality of end flaps, the forming the at least partially closed end of the carton comprising folding the side end flap relative to the side panel to position the bevel panel along a corner of the carton;

wherein the bevel panel comprises features that are shaped and located in the blank according to geometric aspects of one or more articles of the plurality of articles, the one or more articles positioned at the corner of the carton;

wherein a rolling axis of the corner of the carton extends from an upper intersection of the bevel panel to a bottom corner vertex of the carton, a normal axis of the corner is perpendicular to the rolling axis, and an inner vertex and an outer vertex are located on the normal axis;

wherein the one or more articles has a shoulder at a shoulder height from a bottom end of the one or more articles, the normal axis intersects the rolling axis at a point that is spaced apart from the bottom corner vertex of the carton by the shoulder height of the shoulder of the one or more articles; and wherein each of the outer vertex and the inner vertex is spaced apart from the point where the normal axis intersects the rolling axis by a tangential radius, the tangential radius being approximately one half of a radius of the one or more articles at the shoulder.

29. The method of claim 28, wherein the plurality of panels comprises a top panel and a bottom panel foldably connected to the side panel, the positioning the plurality of panels comprises positioning the top panel and the bottom panel to be opposite to one another, the bevel panel is spaced apart from the bottom panel by at least a side segment of a longitudinal fold line, the side end flap is foldably connected to the side panel along at least the side segment, and the bevel panel extends from the top panel to the side segment.

30. The method of claim 28, wherein the bevel panel is foldably connected to the side end flap along an outer bevel fold line and is foldably connected to the side panel along an inner bevel fold line, the outer bevel fold line comprises a first outer segment and a second outer segment that intersect at the outer vertex, and the inner bevel fold line comprises a first inner segment and a second inner segment that intersect at the inner vertex.

31. The method of claim 30, wherein the first outer segment and the first inner segment converge at the upper intersection.

32. The method of claim 28, further comprising loading the plurality of articles into the carton comprising positioning the one or more articles at the corner of the carton.

33. The method of claim 28, wherein:

the side panel is a first side panel, the side end flap is a first side end flap, the bevel panel is a first bevel panel, and the corner is a first corner;

the plurality of panels further comprises a second side panel, the positioning the plurality of panels comprising positioning the first side panel and the second side panel to be opposite to one another;

the plurality of end flaps further comprises a second side end flap;

the blank further comprises a second bevel panel at least partially connecting the second side end flap is to the second side panel; and the forming the at least partially closed end of the carton further comprises folding the second side end flap relative to the second side panel to position the second bevel panel along a second corner of the carton.

* * * * *